United States Patent [19]

Zöllner et al.

[11] 4,447,300

[45] May 8, 1984

[54] ELECTRODE HOLDER FOR USE IN FUSION ELECTROLYSIS

[75] Inventors: Dieter H. Zöllner, Schwaig b. Nürnberg; Inge Lauterbach-Dammler, Nuremberg; Friedrich Rittmann, Rückersdorf b. Nürnberg, all of Fed. Rep. of Germany

[73] Assignee: C. Conradty Nurnberg GmbH & Co. Kg, Röthenbach, Fed. Rep. of Germany

[21] Appl. No.: 411,433

[22] Filed: Aug. 25, 1982

[30] Foreign Application Priority Data

Sep. 10, 1981 [DE] Fed. Rep. of Germany ..... 3135912

[51] Int. Cl.[3] ..... C25C 7/02; C25C 3/02; C25C 3/04; C25C 3/06

[52] U.S. Cl. ..... 204/67; 204/286; 204/297 R; 204/243 R; 204/70; 204/68

[58] Field of Search ..... 204/297 R, 243 R, 67, 204/286, 70, 68

[56] References Cited

U.S. PATENT DOCUMENTS

| | | | |
|---|---|---|---|
| 3,046,213 | 7/1962 | Bender | 204/286 X |
| 3,497,444 | 2/1970 | Paiton | 204/286 X |
| 3,718,571 | 2/1973 | Bidwell | 204/297 R X |
| 3,745,107 | 7/1973 | Jacobs | 204/243 R |
| 3,891,530 | 6/1975 | Alewitz | 204/297 R X |
| 4,247,381 | 1/1981 | Schirnig et al. | 204/67 X |
| 4,280,891 | 7/1981 | Neelameggham | 204/243 R |
| 4,287,045 | 9/1981 | Lechevallier et al. | 204/286 X |

*Primary Examiner*—G. L. Kaplan
*Assistant Examiner*—Nam X. Nguyen
*Attorney, Agent, or Firm*—James J. Ralabate

[57] ABSTRACT

An axially displaceable electrode holder for use in fusion electrolysis, for holding active parts of self-consuming or of slowly self-consuming material by a screw nipple or the like. The electrode holder can have a cooling means with an inflow channel and a return channel and at least partially and preferably in its lower area a protective layer. On its surface a contact arrangement is provided by means of which the electrode holder can be detachably connected to the power supply, while on said electrode holder a plurality of electrical and/or mechanical contact sites are detachably disposed, are made of pressure resistant material, and extend at least over one part of the area of axial displacement of said electrode holder. This electrode holder is distinguished by high operational capacity, flexibility in handling and good electrical properties.

27 Claims, 4 Drawing Figures

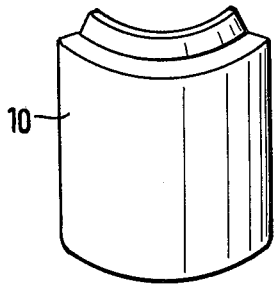
FIG. 2
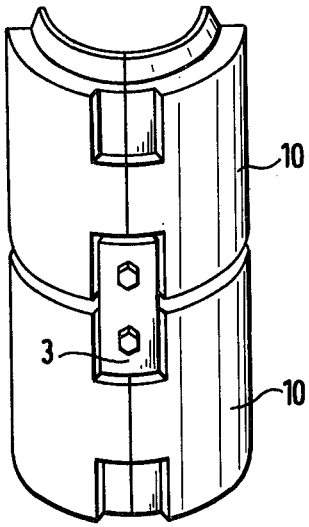
FIG. 3
FIG. 4
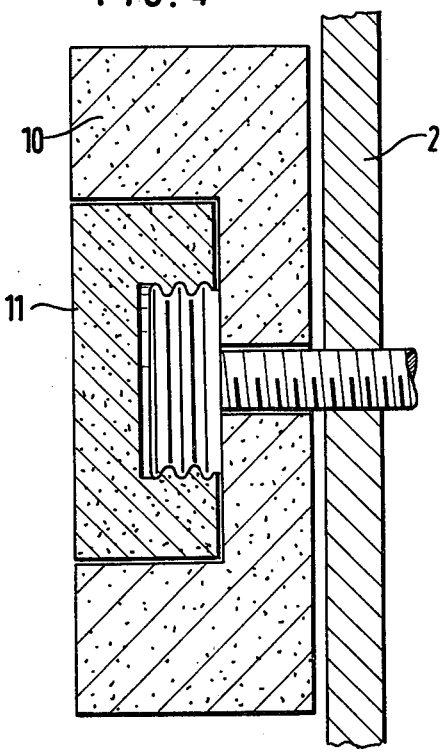

ELECTRODE HOLDER FOR USE IN FUSION ELECTROLYSIS

This invention relates to an electrode holder for use in fusion electrolysis.

A known metallic electrode holder, e.g. of copper or copper alloy, for electrodes of self-consuming or slowly self-consuming material which can be attached by means of a screw nipple or the like, includes a cooling device with a flow channel and a reflux channel and at least partially in its lower area may have a protective coating. On its surface, a contact means is arranged via which the electrode holder can be connected detachably to a power supply. Thus, the electrode holder is intended not only for the mechanical fastening of the active part but also as the power supply. In German Offenlegungsschrift No. 24 25 135 an electrode for fusion electrolysis is described which has an upper metallic electrode holder, e.g. a so-called thermax rod. Electrode sections of ceramic oxide are attached to its lower part. But statements on the special design of the electrode holder are largely lacking.

In Austrian Patent Specification No. 339 061 electrodes for fusion electrolysis of alumina are described, in which the metal shaft of the electrode holder holding the active part is provided with channels for the passage of gas. By means of the flow of protective gas around the electrode, the intention is to counteract the corroding influence of impurities in the smelt.

Finally it has already been proposed by the applicant in his European patent application No. 80 106 580.6 that on the external surface of the electrode holder, connection jaws should be provided which can be secured by semilunate holders. Such a contact area in a length of about 0.2 to 0.5 m on the top end of the metal shaft certainly results in advantages, but it does not lead to the desired flexibility in use of the electrode.

An object of the invention is to provide an electrode holder which permits simple power supply.

Another object of the invention is to provide relatively large axial displaceability during use in smelting furnaces with a high degree of operational safety.

A further object of the invention is to provide an electrode holder which can be held without damage to its metallic surface despite the necessary clamping forces, and is safe to handle during operation.

According to the invention, there is provided an electrode holder for fusion electrolysis comprising: an elongate metal element, connection means on said element for mechanical and electrical connection to an active electrode element of self-consuming material; and external contact means of pressure-resistant material carried by said metal element for detachable mechanical and electrical connection to clamping means, the contact means providing a plurality of contact sites at axially displaced positions to allow axial adjustment of the holder relative to said clamping means.

Some embodiments of the invention will now be explained by way of example with reference to the accompanying drawings, in which:

FIG. 2 shows an individual segment, from which the contact sites can be assembled; and FIGS. 3 and 4 show views of the fastening of several consecutive individual segments, as well as a cover for them.

Figure 1:
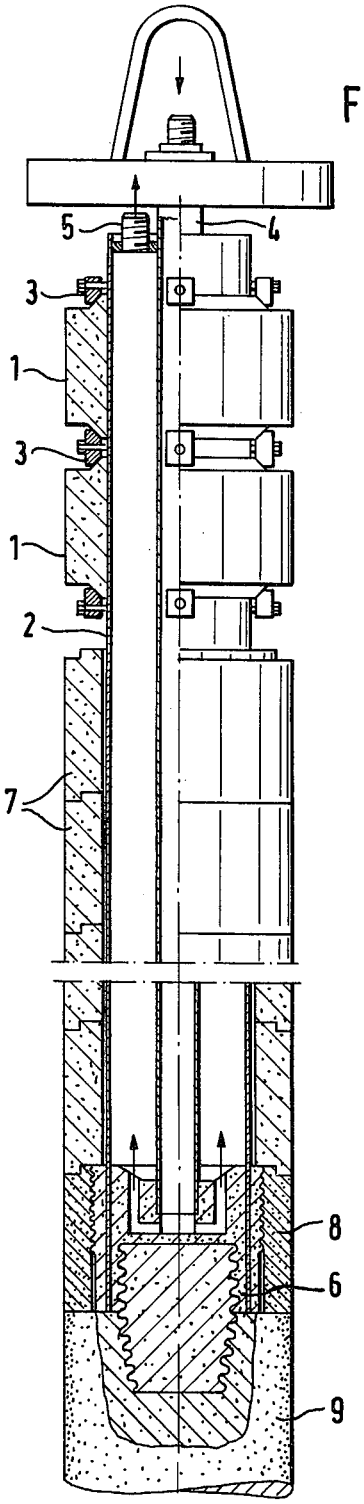
FIG. 1 shows a longitudinal section through a schematically drawn electrode holder.

The term "contact site" is used herein to mean a possible current passage area which has about the width or more of the holder jaws of the clamping means which also serve as the power supply and are normally used in electric arc furnaces for the production of electrosteel.

Reference is made herein to the "axial displacement of the electrode holder". This means the amount by which the electrode must be axially adjusted, for example within the smelt, to compensate for the consumption of the active part, in so far as it is consumable, to the point where a residual "safety margin" remains, e.g. a magnitude of about 0.4 to 0.7 m with an approximately unchanged electric arc stage. This definition refers therefore especially to smelting furnaces, in which consumable active parts are used.

In FIG. 1 contact sites surrounding a shell 2 of an electrode holder are clearly visible. Two discrete contact elements 1 providing respective sites are axially offset. They are positioned on the surface of metal element 2 by holder elements 3 in the center and at top and bottom respectively. Within the electrode holder, cooling tubes 4 and 5 are shown, which accept the inflow and efflux of a cooling agent which may be e.g. water, gas such as air or argon, or liquid metal (e.g. sodium). In the lower area of the electrode holder are provided protective guard segments 7, the last of the guard segments 8 being screwed on by an internal thread to the shell 2 of the metal shaft. By means of a screw-nipple 6 the electrode holder is secured to an active part 9.

The guard elements 7 are preferably resistant to high temperatures. They protect the electrode holder primarily against heat which would inevitably lead to a melting of the holder metal. Such heat influences may for example result from slag splashes within the bath, short circuits, etc. The protective elements consist with advantage of high temperature resistant and electrically conductive material. In one preferred embodiment, two broad contact sites which are axially offset are followed in the lower area of the electrode holder by a series of guard segments, the fastenings of which are optionally covered by conductive covers, while the last guard ring on the lower end of the electrode holder is screwed directly by an internal thread onto the shell as illustrated in FIG. 1. With respect to the design of the guard elements and/or guard segments, attention is drawn to the German patent application of the applicant No. P 31 02 776.8, of which the full relevant content is hereby also introduced.

It is also possible that between the guard segments optionally located in the lower area of the electrode holder and the shell of the internally cooled metal shaft, high temperature resistant, deformable or elastic intermediate materials 12 can be provided. Such intermediate materials are preferably those which are electrically conductive, e.g. graphite foil, or graphite fleece. But it is also possible to use less conductive materials such as ceramic paper, etc. In one special embodiment of the invention, copper gauze, copper stranded wire, etc. are provided.

In some embodiments, it has been found advisable for the contact elements 1 and the guard elements to be substantially flush with each other. This makes the axial displacement of the electrode holder particularly flexible.

The pressure resistant material used for the contact element 1 is preferably graphite or composite materials containing graphite. But it is also possible to use other pressure resistant contact materials which apart from the necessary excellent conductivity also possess a high degree of temperature resistance.

According to the preferred embodiment of the invention as illustrated, the electrode holder has at least two discrete and offset contact elements. But it is also possible that the electrode holder is covered with a continuous surface providing a plurality of said contact sites.

The contact elements are preferably rings, half-cups or segments adjacent to the metal surface and made of highly conductive material, whereby the individual segments can again provide cups. For example, arcuate segments of about 120° of the circumference of the metal shaft 2 can be used, so that in this case a peripheral ring which forms the contact points is formed by three such segments.

FIG. 2 shows schematically one possible design of an individual segment 10, and the sequence and fastening of the contact elements as formed from the segments can be seen in FIG. 3.

It is especially advantageous if the elements forming the contact sites, especially the individual segments 10 where provided, fit tightly on the shell of the electrode. But it is also possible that between the detachably disposed contact elements and the metal shell, a further intermediate and highly conductive, optionally deformable, material is provided at 13 which improves the contact and simultaneously can act as the "buffer substance" in the event of oscillations of the electrode or mechanical loads imposed thereon.

Preferably, the contact sites are arranged in the upper region of the metal element of the electrode holder so that power supply over at least approximately the area of the upper third of the electrode holder is possible. It is particularly preferred that the power supply can be provided over the area of the upper half of the electrode holder, whereby the contact sites are then located in this area of the upper half, and/or they surround continuously or discontinuously the upper half of the shell of the metal shaft.

When using graphite contact segments 10 which form two separate contact points, they can for example be secured in the following way: between the axially displaced contact elements 1 securing elements 3 are centrally provided, e.g. screw couplings, which hold the top and bottom graphite segments simultaneously and which are additionally held in each case from below and above by an identical or other fastening. When forming rings which are composed of three segments 10, it follows that nine holder elements 3 are required for the six graphite contact segments. In the especially favoured embodiment described here it is also possible to convert the two discrete contact sites or contact areas into a continuous holding and contact zone. This can be done e.g. by placing conductive covers 11 on said securing elements 3 (see FIG. 4). In this way, despite the segmented and limited-length individual elements, a length of for example from 0.6 to 2.5 m (but preferably from 0.8 to 1.8 m) can be covered continuously or discontinuously in the upper area of the electrode holder, so that this area can be totally used as the holding and contact zone.

For the securing elements which are e.g. disposed centrally of the individual contact elements it is advisable to provide recesses in which conductive cover elements can be simply installed as shown in FIG. 4. Normally the same material is used for the contact elements and for the covers, which material is pressure resistant, highly electrically conductive and preferably also resistant to high temperatures. But it may also be desirable to design the covers of less conductive material (by comparison with the actual contact points), so that in the event of a spark-over, they do not become the preferred current path.

FIG. 4 shows one arrangement of the mounting of covers 11 on the screw coupling elements 3. As already mentioned, it is normally preferable to use for the cover a material which is electrically less conductive than that of the guard elements themselves, so that in the event of a short circuit, the covers 11 do not become the preferred current path.

In one preferred embodiment of the electrode holder at least two contact sites are disposed in the upper area of the shell, whereby the centers of two broad contact jaws arranged one beneath the other may be mutually displaced by about 0.5 to 0.9 m.

Depending on the application intended for the electrode holder, it may be advisable to fill the contact area between the shell of the electrode holder and the segments forming the contact elements with the sealing substance 13, e.g. putty. Corresponding sealing substances are known, and attention is drawn only as an example to substances containing carbon.

Due to its design, the electrode holder is enabled over a substantial area of its metallic surface to accept the electric current power supply which is often combined with the mechanical fastening of the electrode holder. Since the internally cooled metal shaft of the electrode holder may be subjected to substantial pressures, it has been found especially advantageous for the electrode holder, at least in the area of the contact points, to be supported by internal and mechanically resistant struts 14 which counteract any mechanical deformation of the electrode holder due to the holder or current supply elements. These struts can e.g. be formed from high-strength tubes, rods of steel, etc. The struts can e.g. be secured on the internal cooling tubes, either on the inflow channel or on the return channel or on both. The struts can also be led directly to the inner surface of the metal shaft or they may have a certain small spacing therefrom, so that a limited deformation of the metal shaft becomes possible. By the attachment of struts made of high-strength hard materials, the mechanically less good properties of the highly conductive copper or of its alloys, which are normally used to form the jacket of the electrode holder, can be compensated.

Thus, an electrode holder has been described which is characterized in that at least two electrical and/or mechanical contact sites made of pressure resistant material are detachably mounted and extend at least over a part of the area of axial displacement of the electrode holder.

A number of advantages are attained by the design of the electrode holder. It can be axially displaced over a substantial range of its length even in the case of a static external power supply, without any need for design changes. Due to the easy axial displaceability of the electrode holder in fusion furnaces, the consumption of the active part can be constantly compensated. Moreover it is not necessary to design the length of the electrode holder against the active part so as to be relatively small, since because of the heat protection afforded in the lower area of the electrode holder, it can at least partially itself be introduced into the furnace atmosphere. Thus, even in large-scale smelting furnaces, the length of the active part can be kept in the optimal range. If there is too large a section of a carbon strand in the smelting furnace, there is a relatively high consumption of carbon material which goes far beyond the value theoretically required by the electrode operation. It is therefore favorable if due to a suitable design of the electrode holder it becomes possible to attain a far-reaching axial displacement thereof. This also makes it possible to avoid too frequent nippling-up processes which cause on each occasion a break in production operation. It is also possible by using the design of the electrode holder according to the invention to use normal lengths of graphite electrodes as the active parts. These can be e.g. in the range from 1.8 to 2.2 m in length and be nippled up to the residues of the previously inserted electrodes, e.g. in the range of from 0.4 to 0.8 m in length.

The described electrode holders have special applicability in high temperature processes. Especially, applications can be considered to the extraction of metals by fusion electrolysis. In this case the contact sites and also the optional guard elements in the lower area of the electrode holder can be made gas-tight as well as proof against fluid leaks. This can be done by the use of a high temperature resistant sealing substance such as putty, etc.

Solely as an example, the extraction of sodium, magnesium and aluminum are mentioned here as instances of such fusion electrolysis. When performing such electrolyses it is of course also possible to choose to make the active part of a non-expendable or only slowly self-consuming electrically conductive material. Examples are the ceramic materials, e.g. tin oxide, etc.

In the foregoing a number of embodiments and options have been described but these are purely by way of illustration of the invention whose scope is to be determined solely by the claims forming a part of this disclosure.

I claim:

1. An electrode holder for fusion electrolysis for the electrolytic production of inter alia aluminum, magnesium, sodium and lithium, in which the holder is clamped by clamping jaws for current supply, the holder comprising: an elongate metal element; cooling means internally of said metal element, said cooling means comprising an inflow channel and a return channel for a cooling medium; connection means on said metal element for mechanical and electrical connection to an active electrode element of consumable or non-consumable material; and external contact elements of pressure-resistant material carried by said metal element for detachable mechanical and electrical connection to said clamping jaws, the contact elements providing a plurality of contact sites at axially displaced positions to allow axial adjustment of the holder relative to said clamping jaws.

2. A holder according to claim 1 wherein said contact sites are provided by respective said contact elements.

3. A holder according to claim 2 wherein the contact elements are adjacent rings or cups of highly conductive material.

4. A holder according to claim 3 wherein each ring is formed from a plurality of individual segments.

5. A holder according to claim 4 wherein the connection between said segments and said metal element is filled with a sealing substance.

6. A holder according to claim 1 wherein said contact elements provide a continuous sequence of contact zones.

7. A holder according to claim 1 wherein said contact element is of highly conductive graphite.

8. A holder according to claim 1 wherein the contact element is arranged so that power supply is possible over approximately the upper third of the electrode holder length.

9. A holder according to claim 1 wherein the contact element is arranged so that power supply is possible over approximately the upper half of the electrode holder length.

10. A holder according to claim 1 wherein the contact elements are provided with holding means having conductive covers.

11. A holder according to claim 1 wherein the axial center to center spacing of said sites is in the range of from about 0.5 m to about 0.9 m.

12. A holder according to claim 1 wherein the contact means cover a length of from 0.6 m to 2.0 m in the top area of said metal element.

13. A holder according to claim 1 wherein at least in the area of the contact element internal and mechanically resistant struts are provided to counteract mechanical deformation caused by said clamping means.

14. A holder according to claim 13 wherein said struts are secured on internal cooling pipes.

15. A holder according to claim 1 wherein a protective layer is provided on the lower region of said metal element.

16. A holder according to claim 15 wherein said protective layer comprises high temperature resistant guard segments.

17. A holder according to claim 16 wherein the contact element is substantially flush with said guard segments.

18. A holder according to claim 16 wherein the guard segments are of electrically conductive material.

19. A holder according to claim 18 wherein at least the final guard element arranged on the bottom end of the electrode holder is attached by a screw-thread.

20. A holder according to claim 16 wherein between the guard segments and said metal element a temperature resistant electrically-conductive, deformable or elastic intermediate material is provided.

21. A holder according to claim 20 wherein the intermediate material is graphite foil, graphite fleece, or copper-stranded wire.

22. A holder according to claim 1 wherein said metal element is of copper or copper alloy.

23. A holder according to claim 1 wherein said connection means comprises a screw nipple.

24. In an electrolytic cell for fusion electrolysis for the production of inter alia aluminum, magnesium, sodium and lithium, comprising at least one active anode and one cathode and means for imposing a direct current between the anode and the cathode, the improvement wherein the active anode parts are held by an electrode holder according to claim 1.

25. The cell of claim 24 wherein the active anode parts consist of ceramic material.

26. Fusion electrolysis apparatus comprising: clamping means; an electrode holder clamped by said clamping means; and an active electrode element of consumable material held by said electrode holder, wherein said electrode holder comprises:

(a) an elongate metal element;

(b) connection means on said element connected electrically and mechanically to said electrode element;

(c) external contact elements at least one of which is clamped by said clamping means; and (d) said contact elements providing a plurality of contact sites at axially displaced positions to allow axial adjustment of said holder relative to said clamping means.

27. A method of operating the apparatus of claim 26 during fusion electrolysis in which when said electrode element has been consumed by an amount corresponding to the axial spacing of said contact sites the electrode holder is axially displaced relative to said clamping means to the next adjacent contact site to readjust the position of said electrode element.

* * * * *